US012420897B2

(12) United States Patent
Wu et al.

(10) Patent No.: US 12,420,897 B2
(45) Date of Patent: Sep. 23, 2025

(54) POSITIONING AND RESCUE DEVICE FOR UNMANNED UNDERWATER VEHICLE

(71) Applicants: South China University of Technology, Guangdong (CN); GUANGZHOU SHUNHAI SHIPYARDS LTD., Guangdong (CN); BEIBU GULF UNIVERSITY, Guangxi (CN)

(72) Inventors: Jiaming Wu, Guangdong (CN); Yuqing Chen, Guangdong (CN); Zhiquan Ma, Guangdong (CN); Linhua Li, Guangdong (CN); Xiaokun Hou, Guangdong (CN); Peng Dai, Guangdong (CN); Xiangxi Han, Guangxi (CN)

(73) Assignees: South China University of Technology, Guangzhou (CN); GUANGZHOU SHUNHAI SHIPYARDS LTD., Guangzhou (CN); BEIBU GULF UNIVERSITY, Qinzhou (CN)

( * ) Notice: Subject to any disclaimer, the term of this patent is extended or adjusted under 35 U.S.C. 154(b) by 622 days.

(21) Appl. No.: 17/789,259

(22) PCT Filed: Oct. 20, 2020

(86) PCT No.: PCT/CN2020/122078

§ 371 (c)(1),
(2) Date: Jun. 27, 2022

(87) PCT Pub. No.: WO2021/129080

PCT Pub. Date: Jul. 1, 2021

(65) Prior Publication Data

US 2023/0031851 A1 Feb. 2, 2023

(30) Foreign Application Priority Data

Dec. 27, 2019 (CN) ..... 201911376955.6

(51) Int. Cl.
*B63C 7/28* (2006.01)
*B63C 7/26* (2006.01)
*B63G 8/04* (2006.01)

(52) U.S. Cl.
CPC ..... *B63C 7/28* (2013.01); *B63C 7/26* (2013.01); *B63G 8/04* (2013.01)

(58) Field of Classification Search
CPC .... B63C 7/28; B63C 7/26; B63C 7/10; B63C 7/02; B63G 8/04; B63G 8/001; B63G 2008/002; G01S 19/14
See application file for complete search history.

(56) References Cited

U.S. PATENT DOCUMENTS 5,319,376 A * 6/1994 Eninger ..... G01S 19/36 367/4
6,261,142 B1 * 7/2001 Fiotakis ..... B63B 22/02 441/2

(Continued)

FOREIGN PATENT DOCUMENTS

CN 104816801 A 8/2015
CN 108045537 A 5/2018

(Continued)

OTHER PUBLICATIONS

International Search Report of PCT Patent Application No. PCT/CN2020/122078 issued on Jan. 26, 2021.

*Primary Examiner* — Anthony D Wiest

(57) ABSTRACT

A positioning and rescue device for an unmanned underwater vehicle, comprising a battery (1), a switch (2), a protective resistor (3), an electromagnetic relay (4), a master control chip (5), a GPS positioning system (6), an igniter (7), (Continued)

a partition (8), an air bag (9), a shell (10), and a rope (11). The battery (1), the switch (2), the protective resistor (3), the electromagnetic relay (4) and the master control chip (5) are sequentially connected by means of wires to form a series circuit, and the igniter (7) and the GPS positioning system (6) are separately connected to the master control chip (5) by means of wires; two normally open contacts of a control loop of the electromagnetic relay (4) are respectively connected to two ends of a general power supply (15).

7 Claims, 4 Drawing Sheets

(56) References Cited

U.S. PATENT DOCUMENTS

| | | | | |
|---|---|---|---|---|
| 8,833,288 | B2 * | 9/2014 | Bertelsen | B63B 27/36<br>114/326 |
| 9,889,905 | B2 * | 2/2018 | Albertson | B66F 19/00 |

FOREIGN PATENT DOCUMENTS

| | | | |
|---|---|---|---|
| CN | 109080794 | A | 12/2018 |
| CN | 110272000 | A | 9/2019 |
| CN | 110435854 | A | 11/2019 |
| KR | 20100096767 | A | 9/2010 |

* cited by examiner

POSITIONING AND RESCUE DEVICE FOR UNMANNED UNDERWATER VEHICLE

FIELD OF THE INVENTION

The present invention relates to a positioning and auxiliary rescue device, in particular to a positioning and rescue device for an unmanned underwater vehicle; this positioning and rescue device can be used to locate and rescue a faulty or lost underwater vehicle.

BACKGROUND OF THE INVENTION

With the continuous development of science and technology and people's thirst for resources and exploration of the ocean, the ocean is becoming more and more familiar to people. Marine environment, marine resources and the physicochemical properties of seawater have been extensively studied. Underwater vehicles have become a useful tool for such scientific research.

The underwater vehicles have the characteristics of strong maneuverability, convenient operation, high autonomy, and wide application range. The utilization of the underwater vehicles not only saves labor costs, but also improves work efficiency in the detection of seabed resources, monitoring of hydrological characteristics, measurement of seabed geomorphology, etc.

According to the control mode, the underwater vehicles are mainly divided into unmanned underwater vehicles and manned underwater vehicles. The unmanned underwater vehicles can be further divided into autonomous underwater robots, remote-controlled underwater robots, and underwater towed vehicles. The unmanned underwater vehicle is mainly composed of a vehicle body, mounted instruments, and a control device. Compared with the manned underwater vehicle, the unmanned underwater vehicle has the advantages of high safety, high economical efficiency, convenient operation, and wide adaptability.

The unmanned underwater vehicle may encounter unexpected situations during underwater navigation and exploration. For example, the autonomous underwater robot has internal equipment problems, or it is hit to get stranded and cannot return; the rope or umbilical cord of the underwater towed vehicle or the remote-controlled underwater robot is broken, causing the vehicle to lose control, and so on. It is necessary to search and rescue such faulty or lost underwater vehicles. However, after losing control, the vehicle will sink to the bottom of the detected area, not only difficult to find but also difficult to salvage and rescue.

At present, there are mainly the following two underwater rescue methods: One method is to install an underwater positioning device, which can send real-time positions to a mother ship in time when the unmanned underwater vehicle encounters unexpected situations during underwater navigation and exploration; however, such an underwater positioning device is limited by energy supply and has no auxiliary rescue device; that is, the length of time that the positioning device can send the position signal is limited by the energy stored in the battery, and the positioning device will fail if the battery stops supplying energy; in addition, simply transmitting the position is far from enough in rescuing the underwater vehicle, and such a positioning device lacks auxiliary fairlead devices. The other method is to make the underwater vehicle in a state of positive buoyancy; with this method, the control device is used to make the underwater vehicle sink, while a pressure joint is used for the knot of the rope; when the underwater vehicle encounters an unexpected situation such as being entangled by a fishing net, the tension of the rope may exceed the rated tension of the pressure joint, so that the knot is untied and the underwater vehicle floats under the action of positive buoyancy; however, such a positioning and rescue device is limited by the ballast of the underwater vehicle and the on-site conditions; when the underwater vehicle is stuck or the underwater obstacle is too heavy, it is difficult for the underwater vehicle to rise by buoyancy, which makes such a rescue device ineffective.

Therefore, the rescue device of the underwater vehicle needs not only the positioning function, but also the auxiliary rescue function. The installation of a device with both positioning and auxiliary rescue functions on the underwater vehicle can largely help solve the problem that the underwater vehicle is difficult to find and rescue when it fails or loses contact during navigation.

CONTENTS OF THE INVENTION

In order to solve the problem that the underwater vehicle is difficult to find and rescue when it fails or loses contact, the present invention provides a device with both positioning and rescue functions, which enables the underwater vehicle to be quickly located and rescued after losing control, thereby saving a lot of search and rescue costs.

Base on the positioning function, the present invention adopts the method of "threading a needle" to rescue the underwater vehicle conveniently by inflating an air bag to generate buoyancy for surfacing. The circuit adopted in the present invention is convenient and simple, and not easy to be damaged, guaranteeing timely rescue and reduction of property losses.

The present invention is realized by the following solution:

A positioning and rescue device for an unmanned underwater vehicle is provided, comprising a battery, a switch, a protective resistor, an electromagnetic relay, a master control chip, a GPS positioning system, an igniter, a partition, an air bag, a shell, and a rope; the shell, as a hollow structure, is divided by the partition into two portions, a non-watertight cavity and a watertight cavity; the non-watertight cavity is provided inside with the rope, the air bag, and the igniter arranged on the air bag; the watertight cavity is provided inside with the battery, the switch, the protective resistor, the electromagnetic relay, the master control chip, and the GPS positioning system;

the battery, the switch, the protective resistor, the electromagnetic relay and the master control chip are sequentially connected by means of wires to form a series circuit, wherein two contacts of a controlled loop of the electromagnetic relay are respectively connected to the protective resistor and the master control chip by means of wires; the igniter and the GPS positioning system are respectively connected to the master control chip by means of wires; two normally open contacts of a control loop of the electromagnetic relay are respectively connected to two ends of a general power supply, with the general power supply arranged on a tugboat or coming with the underwater vehicle;

one end of the rope passes through an annular structure, and the other end of the rope passes through the annular air bag, with the two ends tied together into a knot near the annular air bag.

In order to further achieve the object of the present invention, preferably, the hollow structure is a hollow cylinder.

Preferably, the annular structure, made of stainless steel or aluminum alloy, is a high-strength structure on the underwater vehicle.

Preferably, both ends of the shell are sealed with a lid.

Preferably, a sealing hole is provided on the partition to allow the wire to connect to the igniter in the non-watertight cavity through the partition, and is subjected to watertight treatment.

Preferably, the GPS positioning system adopts the NEO-6M module of UBLOX Company, having 50 channels and a tracking sensitivity as high as −161 dBm.

Preferably, the master control chip is an ARM7 chip, which has low power consumption and fast running speed.

Preferably, the air bag, containing substances such as sodium azide ($NaN_3$) or ammonium nitrate ($NH_4NO_3$), is made of rubber and has a tire-like annular shape. After ignition, these substances rapidly decompose and produce a large amount of gas to fill the air bag (sodium azide decomposes to produce nitrogen gas and solid sodium, and ammonium nitrate decomposes to produce a large amount of nitrous oxide ($N_2O$) gas and water vapor). For the sake of safety, the igniter is an electrode plug airbag igniter, which is installed on the air bag in a position where the air tightness must be guaranteed.

Preferably, the rope is made of polyester fiber; the rope can be appropriately lengthened according to the water depth of the working area of the underwater vehicle, so as to ensure that the air bag can still surface even when the underwater vehicle sinks to the bottom.

Preferably, the electromagnetic relay is a Chint small intermediate relay 24V JZX-22F, which is connected to normally open contacts (i.e. these contacts are in a disconnected and non-conducting state under normal circumstances and in a connected and conducting state after being powered).

The battery is mainly used to provide power for the master control chip, so its voltage can be kept at 12 V; it is preferably a Puxun PXE-3S1P1 lithium battery, which is small in size (18 mm×54 mm×67 mm) and light in weight (<100 g).

Compared with the prior art, the present invention has the following advantages and beneficial effects:

(1) Simple structure, and easy loading and unloading: The present invention has a small volume (about $\pi\times7.5\times7.5\times10$ $cm^3$), a weight less than 1 kg, strong adaptability and small floor area, and can be widely installed in underwater vehicles of different shapes without affecting its own instrument layout and manipulation of the underwater vehicles.

(2) Strong maneuverability, and quick and effective response: In the event of dangers such as power failure, stranding, and collision of the remote-controlled unmanned underwater vehicle or the umbilical cord of the towed unmanned underwater vehicle, the present invention takes a common feature of these dangers, power failure, as a signal and triggers the electromagnetic relay switch to supply power to the master control chip; the master control chip transmits signals to the igniter and the GPS positioning system, so that the GPS positioning system can send the position of the underwater vehicle and the air bag can be triggered at the same time; this feedback mechanism can be realized within 1 s with rapid and effective response, not requiring manual operation. When the underwater vehicle loses power or contact due to failure, the positioning and rescue device of the present invention can be automatically started, so that the underwater vehicle can be positioned and rescued, which is convenient for people to search and rescue the underwater vehicle failing or losing contact.

(3) Auxiliary rescue, simple and efficient method: After receiving the signal from the master control chip, the igniter ignites to make the chemical substances in the air bag react and produce a large amount of gas, so that the air bag expands and generates buoyancy; the air bag begins to rise, thereby driving the rope connected to the air bag to start to rise; after the rope has surfaced, a searcher can tie one end of the rope to a high-strength wire rope for rescue, so as to pull the other end of the rope; guided by the rope, the wire rope passes through the high-strength annular structure to allow the vehicle to be pulled up by pulling the wire rope, thereby making the rescue convenient, fast and effective.

(4) The circuit is simple and reliable, easy to connect and achieve: The circuit of the present invention is a series circuit formed by connecting the battery, the switch, the protective resistor, the two contacts of the controlled loop of the electromagnetic relay, and the master control chip, the master control chip controlling the igniter and the GPS positioning system. With the components in the circuit easy to purchase, the circuit is simple, easy to connect, and not easily damaged, meeting the requirements of use.

In the figures: 1. battery; 2. switch; 3. protective resistor; 4. electromagnetic relay; 5. master control chip; 6. GPS positioning system; 7. igniter; 8. partition; 9. air bag; 10. shell; 11. rope; 12. lid; 13. annular structure; 14. wire rope; and 15. general power supply.

DETAILED DESCRIPTION OF THE EMBODIMENTS

In order to better understand the present invention, the present invention will be further described below in conjunction with the appended drawings; however, the protection scope claimed in the present invention is not limited to the scope described in the embodiments.

Figure 1:
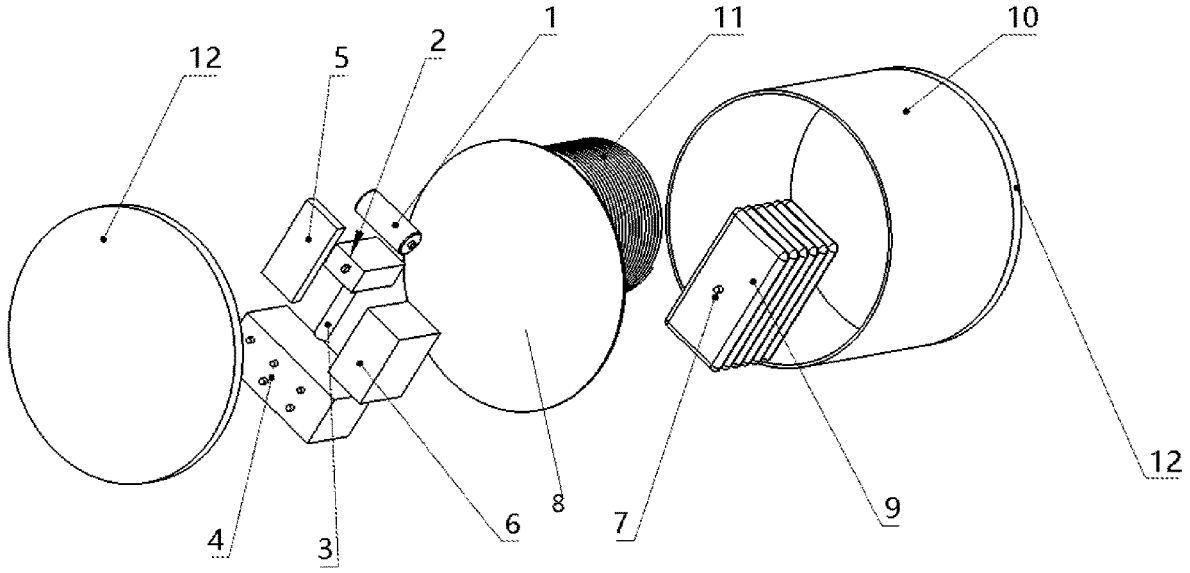
FIG. 1 is an exploded view of the structure of the positioning and rescue device for an unmanned underwater vehicle of the present invention.
Figure 2:
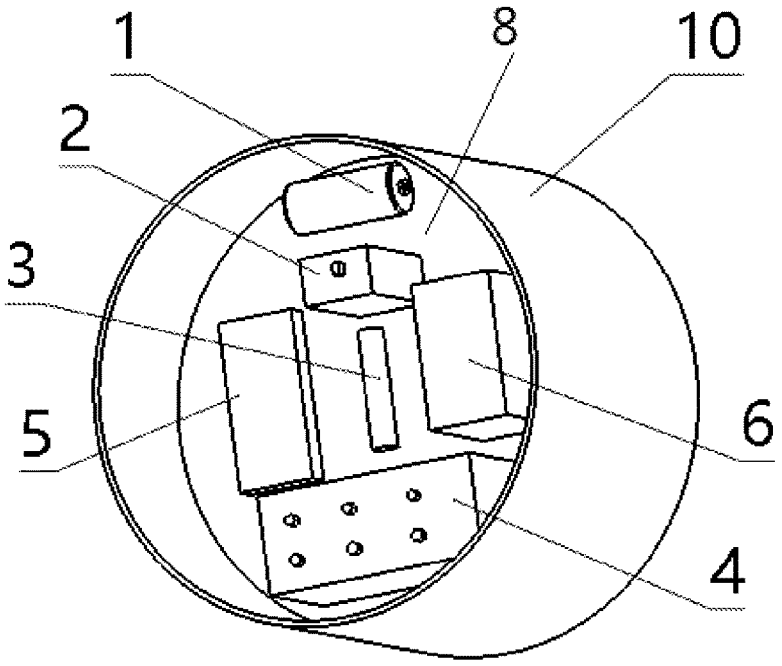
FIG. 2 is a schematic diagram of the arrangement of the components in the watertight cavity in FIG. 1.
Figure 3:
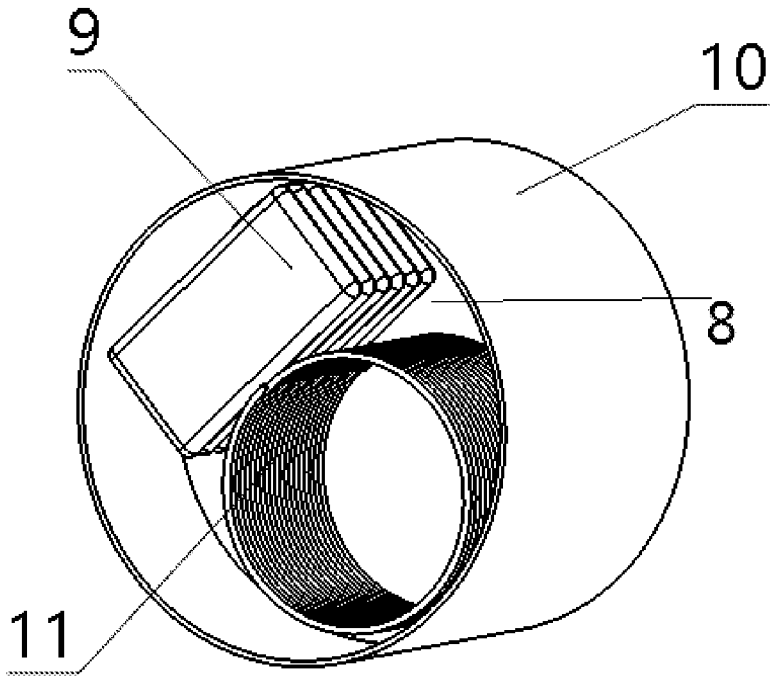
FIG. 3 is a schematic diagram of the arrangement of the components in the non-watertight cavity in FIG. 1.

As shown in FIGS. 1-3, a positioning and rescue device for an unmanned underwater vehicle mainly comprises a battery 1, a switch 2, a protective resistor 3, an electromagnetic relay 4, a master control chip 5, a GPS positioning system 6, an igniter 7, a partition 8, an air bag 9, a shell 10, a rope 11, and a lid 12; the shell 10, as a hollow structure, is preferably a hollow cylinder with both ends sealed with the lid 12, and is divided by the partition 8 into two portions, a non-watertight cavity and a watertight cavity; the non-watertight cavity is provided inside with the rope 11, the air bag 9, and the igniter 7 arranged on the air bag 9; the watertight cavity is provided inside with the battery 1, the switch 2, the protective resistor 3, the electromagnetic relay 4, the master control chip 5, and the GPS positioning system 6.

Figure 4:
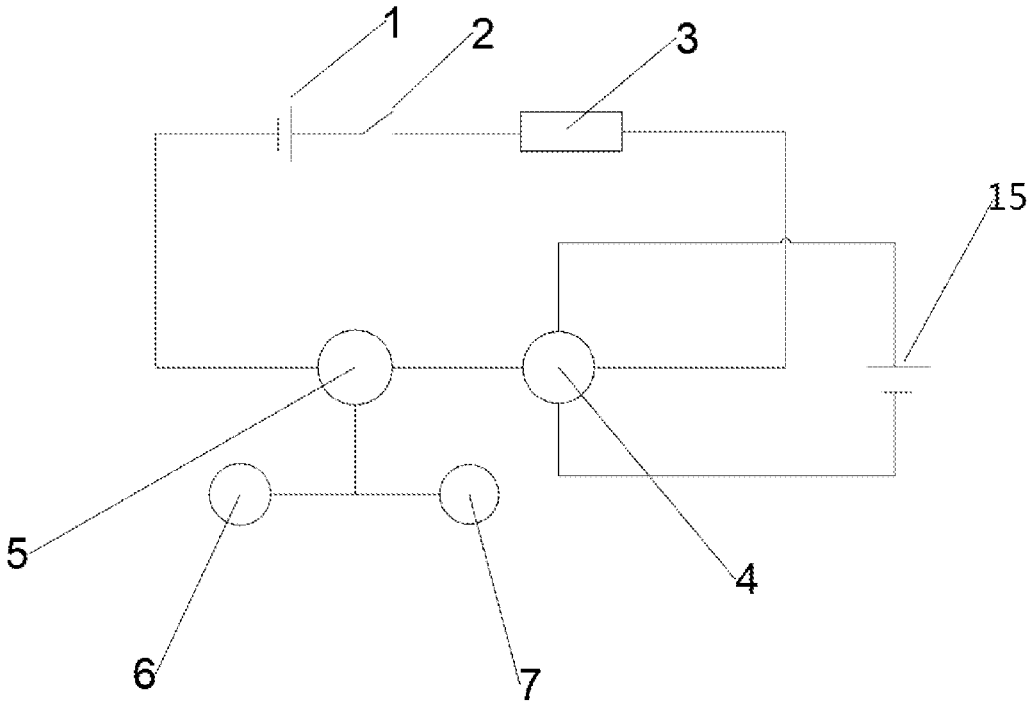
FIG. 4 is a circuit diagram of the positioning and rescue device for an unmanned underwater vehicle of the present invention.

As shown in FIG. 4, the battery 1, the switch 2, the protective resistor 3, the electromagnetic relay 4 and the master control chip 5 are sequentially connected by means of wires to form a series circuit, wherein the two contacts of the controlled loop of the electromagnetic relay 4 are respectively connected to the protective resistor 3 and the master control chip 5 by means of wires; the igniter 7 and the GPS positioning system 6 are respectively connected to the master control chip 5 by means of wires, and the master control chip 5 sends a signal to control the igniter 7 and the GPS positioning system 6; the two normally open contacts of the control loop of the electromagnetic relay 4, which are in a disconnected and non-conducting state under normal circumstances and in a connected and conducting state after being powered, are respectively connected to the two ends of the general power supply 15, with the general power supply 15 arranged on a tugboat or coming with the underwater vehicle.

Figure 5:
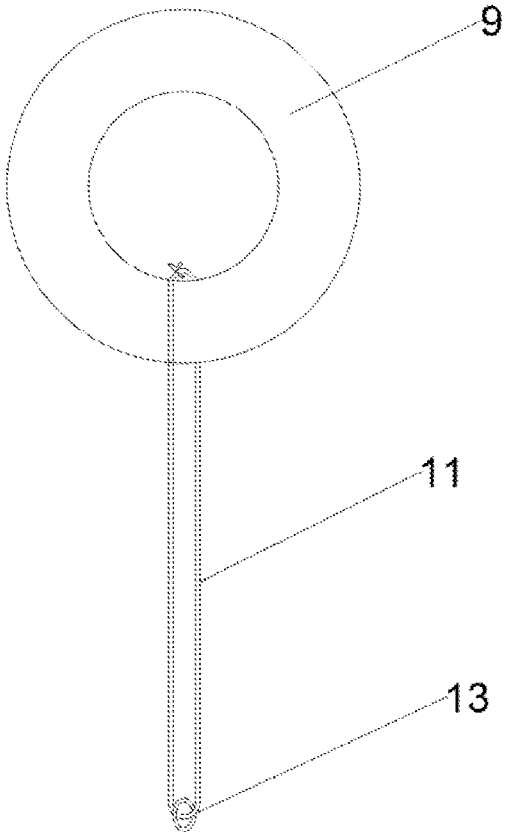
FIG. 5 is a schematic diagram after the air bag is inflated.

As shown in FIG. 5, one end of the rope 11 passes through the annular structure 13, and the other end of the rope 11 passes through the annular air bag 9, with the two ends tied together into a knot near the annular air bag 9; preferably, the annular structure 13 is a high-strength structure made of stainless steel or aluminum alloy on the underwater vehicle.

Figure 6:
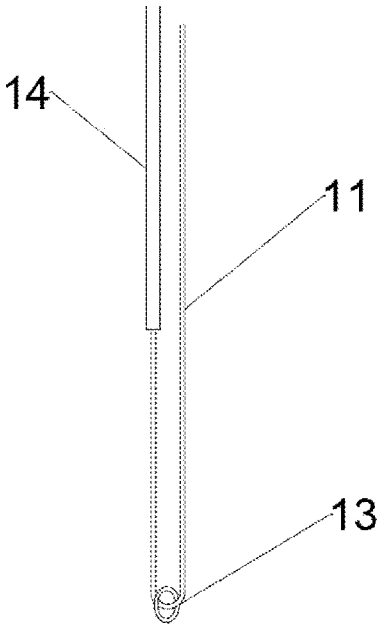
FIG. 6 is a schematic diagram of a rope guiding a wire rope.
Figure 7:
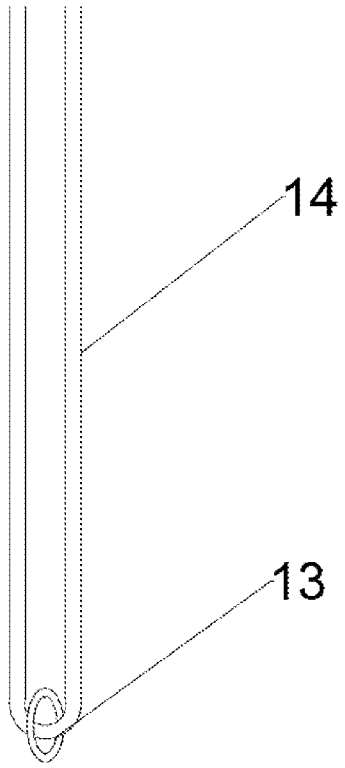
FIG. 7 is a schematic diagram of the wire rope pulling the underwater vehicle.

After the air bag 9 is inflated to rise, the connected rope 11 rises to the water surface. As shown in FIG. 6, a searcher finds the air bag 9 by positioning, and unties the knot near the air bag 9; the searcher ties one end of the rope 11 to the wire rope 14 so as to pull the other end of the rope 11; and the wire rope 14, guided by the rope 11, passes through the high-strength annular structure 13. As shown in FIG. 7, when the wire rope returns to the water surface under the guidance of the rope 11, the searcher can fix both ends of the wire rope on a winch of the rescue ship, and drives the annular structure 13 by pulling the wire rope 14 so as to pull the underwater vehicle up from the bottom of the water, thereby rescuing the underwater vehicle.

In order to ensure the watertightness of the watertight cavity, a sealing hole is provided on the partition 8 to allow the wire of the igniter 7 to pass through, and is subjected to watertight treatment. The wire is connected to the igniter 7 in the non-watertight cavity through the partition; the position where the igniter 7 is installed on the air bag 9 must be airtight.

When the unmanned underwater vehicle encounters dangers such as breakage of the towing rope, stranding or collision, and exhaustion of power, the general power supply 15 on the tugboat or the underwater vehicle cannot continue to supply power to the underwater vehicle; this converts the state of the control loop of the electromagnetic relay 4 from non-conduction to conduction, so that the two normally open contacts of the control loop of the electromagnetic relay 4 are closed to get connected; thus, the series circuit formed by the battery 1, the switch 2, the protective resistor 3, the electromagnetic relay 4 and the master control chip 5 is turned on. The battery 1 supplies power to the master control chip 5, so that the master control chip 5 generates a current signal, which is transmitted to the igniter 7 and the GPS positioning system 6 through wires. The GPS positioning system 6 sends the positioning information to the searcher; the igniter 7 ignites to make the chemical substances in the air bag react and produce a large amount of gas, so that the air bag 9 expands to eject the lid 12; under the action of buoyancy, the igniter 7 is disconnected from the wire and starts to rise until it reaches the water surface. This process does not need to be performed manually. After the underwater vehicle fails, the positioning and rescue device can be automatically turned on, so that the underwater vehicle can be positioned and rescued.

The battery 1 is mainly used to provide power for the master control chip 5, so its voltage can be kept at 12 V; it is preferably a Puxun PXE-3S1P1 lithium battery, which is small in size (18 mm×54 mm×67 mm) and light in weight (<100 g).

Preferably, the GPS positioning system 6 adopts the NEO-6M module of UBLOX Company, having 50 channels and a tracking sensitivity as high as −161 dBm.

Preferably, the master control chip 5 is an ARM7 chip, which has low power consumption and fast running speed.

Considering the requirements for lightness, softness and easy folding, the rope 11 is preferably made of polyester fiber; the rope can be appropriately lengthened according to the water depth of the working area of the underwater vehicle, so as to ensure that the air bag 9 can still surface even when the underwater vehicle sinks to the bottom.

The air bag 9, containing substances such as sodium azide ($NaN_3$) or ammonium nitrate ($NH_4NO_3$), is preferably made of rubber, and has a tire-like annular shape. After ignition, these substances rapidly decompose and produce a large amount of gas to fill the air bag. Sodium azide decomposes to produce nitrogen gas and solid sodium, and ammonium nitrate decomposes to produce a large amount of nitrous oxide ($N_2O$) gas and water vapor.

For the sake of safety, the igniter 7 is an electrode plug airbag igniter, which is installed on the air bag in a position where the air tightness must be guaranteed.

The electromagnetic relay 4 is a Chint small intermediate relay 24V JZX-22F, which is connected to normally open contacts (i.e. these contacts are in a disconnected and non-conducting state under normal circumstances and in a connected and conducting state after being powered).

The specific working process of the positioning and rescue device for an unmanned underwater vehicle of the present invention is as follows:

When the unmanned underwater vehicle is about to navigate, the switch 2 is closed, and then the underwater vehicle is immersed in the water for detection and other work.

When the unmanned underwater vehicle encounters dangers such as breakage of the towing rope, stranding or collision, and exhaustion of power during its navigation, the general power supply 15 on the tugboat or the underwater vehicle cannot continue to supply power to the underwater vehicle; this results in that the wire connected to the normally open contacts of the electromagnetic relay 4 cannot supply power, that is, an action from power on for conduction to power off for non-conduction is performed on the normally open contacts; this action causes the controlled loop of the electromagnetic relay 4 to be in a conducting state, thereby turning on the series circuit formed by the battery 1, the switch 2, the protective resistor 3, the two contacts of the controlled loop of the electromagnetic relay 4, and the master control chip 5. Then the battery 1 supplies power to the master control chip 5, the current signal is transmitted to the GPS positioning system 6 and the igniter 7 through wires, and the GPS positioning system 6 sends the real-time position of the underwater vehicle to the searcher; the igniter 7 ignites to make the chemical substances in the air bag 9 react and produce a large amount of gas, so that the air bag 9 expands to generate buoyancy and eject the lid 12 and starts to rise together with the rope 11 to the water surface. During the rise of the air bag 9, the igniter 7 is disconnected from the wire, the watertight structure remains on the underwater vehicle, and the air bag 9, the igniter 7, and the rope 11 connected to the air bag 9 in the non-watertight structure all begin to rise to the water surface. Then the searcher finds the air bag 9 by positioning, and ties one end of the rope 11 to the wire rope 14 so as to pull the other end of the rope 11; and the wire rope 14, guided by the rope 11, passes through the high-strength annular structure 13; thus, the searcher can rescue the underwater vehicle by pulling the wire rope 14.

When the task is completed without an accident, after the unmanned underwater vehicle is recovered, first the switch 2 is turned off to make the rescue device in a shutdown state, and then the general power supply 15 on the tugboat or the underwater vehicle is disconnected.

As described above, the functions of the positioning and rescue device for an unmanned underwater vehicle of the present invention are well realized. The present invention is not restricted by the above-mentioned embodiments; any other alteration, modification, replacement, combination and simplification not departing from the spiritual essence and principle of the present invention shall be the equivalent substitution and included in the protection scope of the present invention.

The invention claimed is:

1. A positioning and rescue device for an unmanned underwater vehicle, comprising: a battery, a switch, a protective resistor, an electromagnetic relay, a master control chip, a GPS positioning system, an igniter, a partition, an air bag, a shell, and a rope; the shell, as a hollow structure, is divided by the partition into two portions, a non-watertight cavity and a watertight cavity; the non-watertight cavity is provided inside with the rope, the air bag, and the igniter arranged on the air bag; the watertight cavity is provided inside with the battery, the switch, the protective resistor, the electromagnetic relay, the master control chip, and the GPS positioning system;

the battery, the switch, the protective resistor, the electromagnetic relay and the master control chip are sequentially connected by means of wires to form a series circuit, wherein two contacts of a controlled loop of the electromagnetic relay are respectively connected to the protective resistor and the master control chip by means of wires; the igniter and the GPS positioning system are respectively connected to the master control chip by means of wires; two normally open contacts of a control loop of the electromagnetic relay are respectively connected to two ends of a general power supply, with the general power supply arranged on a tugboat or coming with the underwater vehicle;

wherein one end of the rope passes through an annular structure of the underwater vehicle, another end of the rope is releasably connected to the air bag, and a knot of the rope capable of releasing the air bag from the rope is located adjacent to the air bag;

wherein the air bag contains sodium azide or ammonium nitrate, and the igniter is configured to ignite to make the sodium azide or ammonium nitrate in the air bag react and produce nitrogen gas or nitrous oxide gas when the igniter receives a signal from the master control chip, such that the air bag inflates and rises to carry the knot of the rope to a water surface;

wherein the rope is adapted to guide a wire rope through the annular structure of the underwater vehicle for pulling the underwater vehicle when the knot is untied.

2. The positioning and rescue device for an unmanned underwater vehicle according to claim 1, wherein the shell is a hollow cylinder.

3. The positioning and rescue device for an unmanned underwater vehicle according to claim 1, wherein the annular structure is made of stainless steel or aluminum alloy.

4. The positioning and rescue device for an unmanned underwater vehicle according to claim 1, wherein both ends of the shell are sealed with a lid.

5. The positioning and rescue device for an unmanned underwater vehicle according to claim 1, wherein a sealing hole is provided on the partition to allow the wire to connect to the igniter in the non-watertight cavity through the partition, and is subjected to watertight treatment.

6. The positioning and rescue device for an unmanned underwater vehicle according to claim 1, wherein the air bag; is made of rubber and has a tire-like annular shape.

7. The positioning and rescue device for an unmanned underwater vehicle according to claim 1, wherein the rope releasably connected to the air bag is made of polyester fiber.

* * * * *